US005715638A

United States Patent [19]

Anderson, Sr.

[11] Patent Number: 5,715,638

[45] Date of Patent: Feb. 10, 1998

[54] FABRIC WALL PANEL SYSTEM

[76] Inventor: Andy Anderson, Sr., 112 Mallard Dr., Carrollton, Ga. 30117

[21] Appl. No.: 645,950

[22] Filed: May 14, 1996

[51] Int. Cl.[6] ..... E04B 2/10

[52] U.S. Cl. ..... 52/506.08; 52/144; 52/145; 52/506.09; 52/404.2; 52/511; 52/512

[58] Field of Search ..... 52/506.08, 511, 52/506.09, 406.02, 404.2, 144, 145, 745.06, 512; 411/508, 913; 40/757

[56] References Cited

U.S. PATENT DOCUMENTS

| | | | |
|---|---|---|---|
| 2,112,631 | 3/1938 | MacDonald | 52/144 |
| 3,706,171 | 12/1972 | Shayman | 52/506.08 |
| 3,948,347 | 4/1976 | Rutledge | 52/145 X |
| 3,963,094 | 6/1976 | Nowikas | 52/144 X |
| 3,971,867 | 7/1976 | Randall | 52/145 X |
| 4,018,260 | 4/1977 | Baslow . | |
| 4,146,999 | 4/1979 | Petrovec et al. | 52/145 |
| 4,197,923 | 4/1980 | Harris et al. | 52/144 X |
| 4,283,891 | 8/1981 | Moeller | 52/144 |
| 4,479,339 | 10/1984 | Kroh | 52/144 X |
| 4,731,972 | 3/1988 | Anderson . | |
| 5,009,043 | 4/1991 | Kurrasch | 52/144 X |
| 5,174,086 | 12/1992 | Payne et al. | 52/145 X |

*Primary Examiner*—Carl D. Friedman
*Assistant Examiner*—W. Glenn Edwards
*Attorney, Agent, or Firm*—Jones & Askew

[57] ABSTRACT

A fabric wall panel system which mounts wall panels by means of releasable hanger. The fabric wall panel system includes a wall panel and a hanger. The fabric wall panel comprises a frame and a flat filler insert. The frame comprises a plurality of linear frame members. Each frame member has a spine with an elongated opening, a side edge, and a front edge which together define a groove. The flat filler insert is fitted within the groove of each frame member. Fabric is stretched over the frame and insert and is bonded to the back of each frame member to complete the finished fabric wall panel. The hanger has a flat base and a perpendicularly extending tongue with an enlarged head. A number of hangers are affixed on the wall using an adhesive. The slit on the fabric wall panel is aligned with the tongue of hanger on the wall, and the fabric wall panel is affixed to the wall by pressing the slit over the tongue on the hanger. The fabric wall panels can be prefabricated or installed in situ. The fabric wall panels can also be independently replaced or removed entirely by simply unsnapping the fabric wall panel from the supporting hangers.

4 Claims, 3 Drawing Sheets

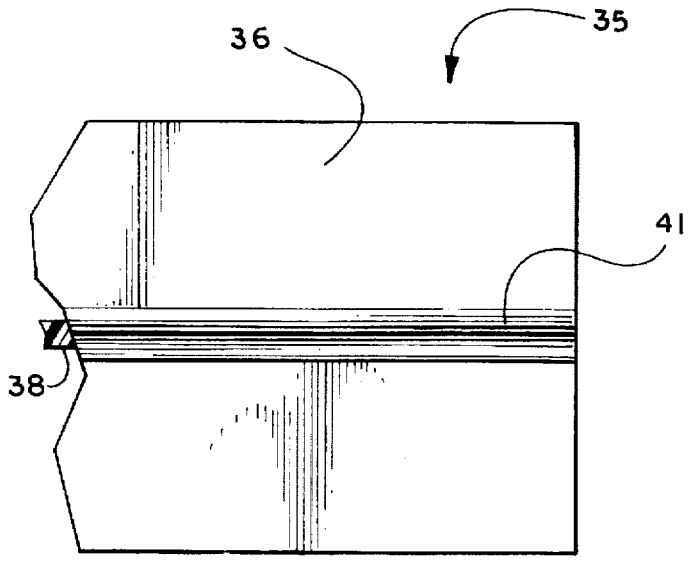
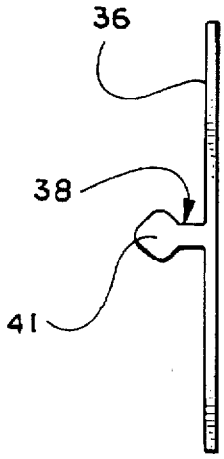
Fig. 4a
Fig. 4b
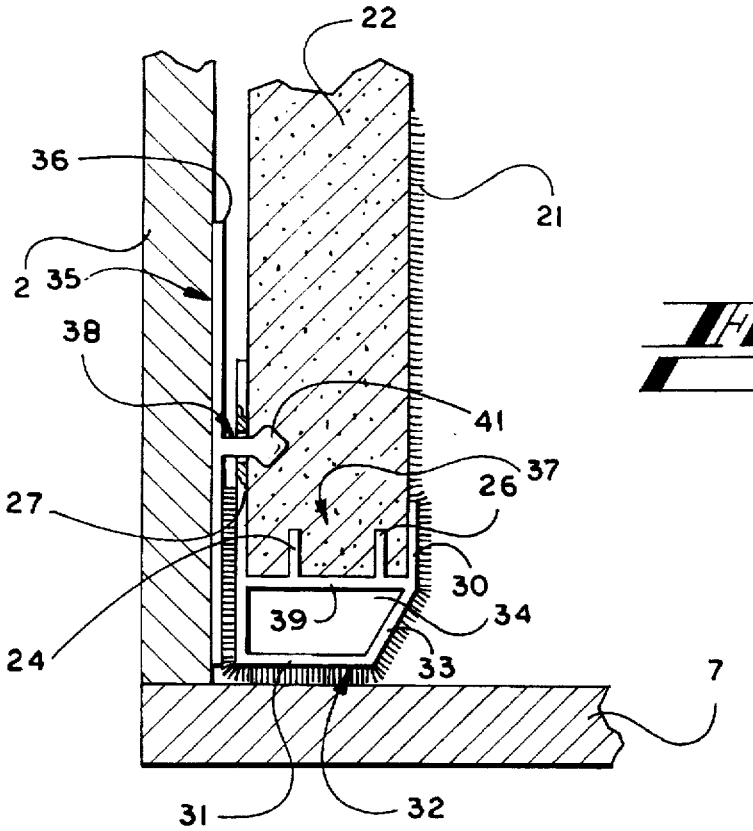
Fig. 5

FABRIC WALL PANEL SYSTEM

FIELD OF THE INVENTION

This invention relates to a fabric wall panel system for use in decorating, and is more particularly directed to a fabric wall panel system which uses hangers for releasably mounting the fabric wall panels on a wall. The hangers allow for easy removal or replacement of the fabric wall panels without causing damage to the wall.

BACKGROUND OF THE INVENTION

Fabric wall panels are used to decorate the interior space in any building. Fabric coverings for the panels are available in numerous textures and patterns which can be coordinated with the furnishings and carpets in any room. These fabric wall panels can be customized to meet the decorating needs of various locations and decorating tastes.

Besides decorating versatility, fabric wall panels provide other highly desirable features. Such features include sound and heat insulation. In large rooms, such as auditoriums and theaters, acoustical insulation and muting may be desired. This desire can be fulfilled by providing fabric wall panels that include a layer of acoustical material hidden behind the fabrics, which modifies the acoustical character of the room.

Some prior fabric wall panels are installed in situ. For example, as disclosed by the patent to Baslow, U.S. Pat. No. 4,018,260, border pieces of a panel are permanently attached to the wall to form a framework for mounting a fabric sheet. The fabric sheet completely covers the wall without being adhered to the wall itself. The linear border pieces include a keyway into which the fabric is forced by means of a compressible spline. The linear border pieces also include a storage channel, which allows the border pieces to create a finished look at the edges. The Baslow patent does not disclose a method of fabric wall panel prefabrication.

In addition, fabric wall panels can be prefabricated. One method for installing prefabricated fabric wall panels employs a cross-nailing system as disclosed by the patent to Anderson, U.S. Pat. No. 4,731,972. The fabric wall panels disclosed in the Anderson patent are prefabricated and then installed by driving two headless pin nails at an angle in a crossed fashion through the frame pieces of the prefabricated panels. The crossed nails penetrate completely through the fabric, partially penetrate the frame, and securely fasten the panel to the wall. A fabric wall panel attached using this cross-nailing method cannot be easily removed from the wall if one should desire to replace panels or remove the panels entirely.

The prior art has failed to disclose a fabric wall panel system of prefabricated panels that can be easily removed from the wall without damaging the wall.

SUMMARY OF THE INVENTION

The present invention satisfies the above-described need by providing a fabric wall panel system and method for installing fabric wall panels. The fabric wall panels can be prefabricated or installed in situ, and removal of the fabric wall panels does not damage the wall. The fabric wall panel system of the present invention comprises a wall panel and a hanger.

The wall panel comprises a frame and a flat filler insert. The frame comprises a plurality of linear frame members. Each frame member has a flat spine with an opening, a side edge, and a front edge. The opening in the spine is an elongated slit. The spine, side edge, and the front edge together form a groove. The flat filler insert is then fitted within the groove of each frame member thereby forming the panel. The panel is covered with fabric, and the fabric is wrapped around the panel and bonded to the spine of each frame member.

The hanger comprises a flat base with a tongue protruding perpendicularly therefrom. The base of the hanger is affixed to the wall with an adhesive, and the tongue projects outward from the wall. The tongue has an enlarged head. The tongue of the hanger is aligned with and pressed into the opening on the spine of the frame member of the fabric wall panel. The enlarged head of the tongue snaps into the slit so that the panel is releasably secured to the wall. The fabric wall panels can thus be easily removed entirely by simply unsnapping the panel from the supporting hangers.

It is therefore an object of the present invention to provide an improved fabric wall panel system which allows easy removal and replacement of individual wall panels.

It is a further object of the present invention to provide a fabric wall panel which can be prefabricated or custom fabricated in situ and which can be attached to a wall by using hangers.

It is another object of the present invention to provide a system for installing fabric walls panels using hangers, whereby the removal and replacement process does not cause damage to a wall.

These and other objects, features, and advantages of the present invention may be more clearly understood and appreciated from a review of the following detailed description of the disclosed embodiments and by reference to the appended drawings and claims.

BRIEF DESCRIPTION OF THE DRAWINGS

FIGS. 4(*a*) and 4(*b*) are top plan view and side elevation view of a hanger used for mounting a fabric wall panel onto a wall in accordance with the preferred embodiment of the present invention.

FIG. 5 is a cross-section view of a frame member mounted to a wall using a hanger in accordance with the preferred embodiment of the present invention.

DETAILED DESCRIPTION OF THE PREFERRED EMBODIMENT

Figure 1:
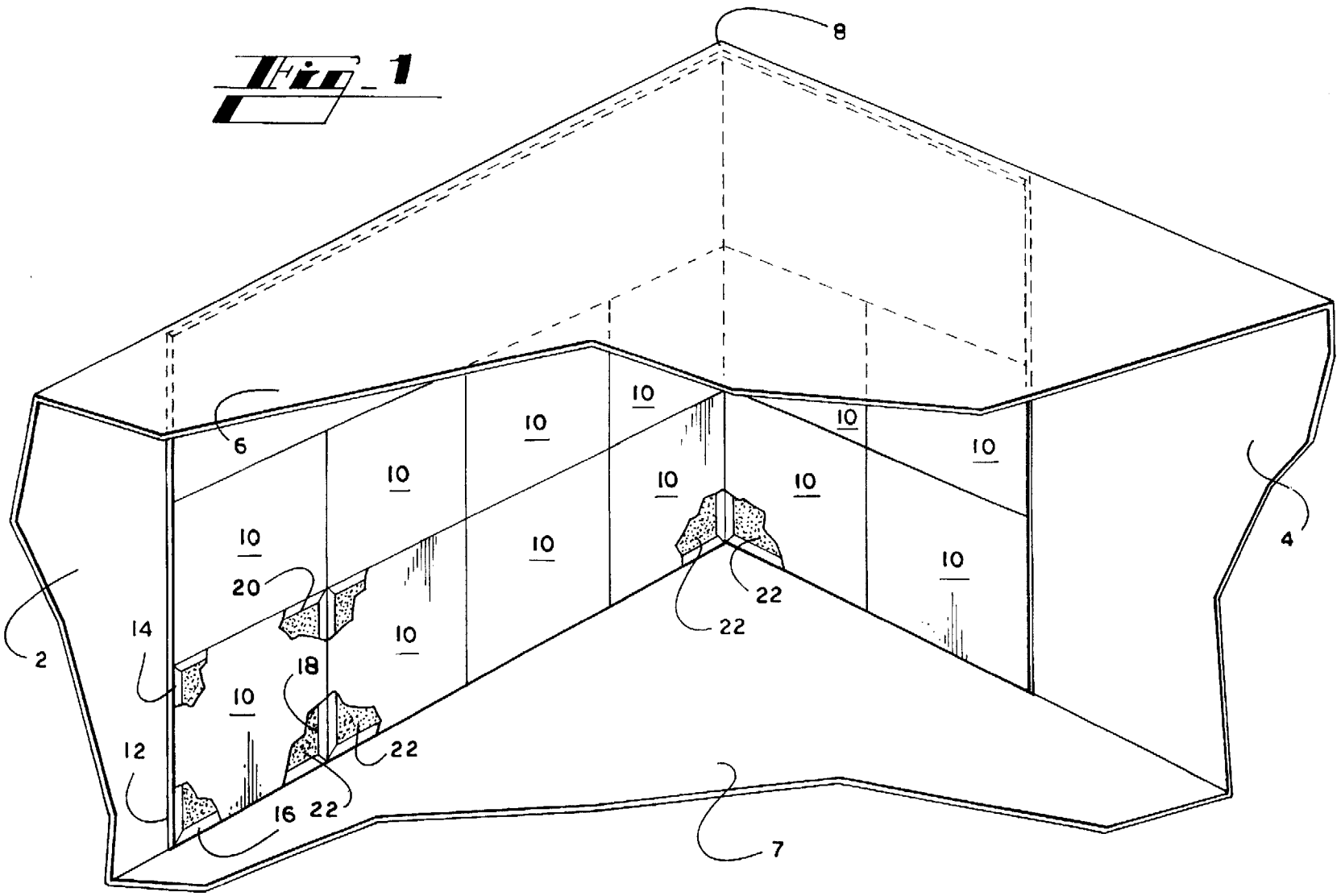
FIG. 1 is a perspective view of walls covered with a fabric wall panel system in accordance with the preferred embodiment of the present invention.

The present invention is directed to a fabric wall panel system and method for installing fabric wall panels. The fabric wall panels of the present invention can be prefabricated or installed in situ. The fabric wall panel system employs a hanger that is mounted to the wall and that releasably engages the fabric wall panel for easy removal without damaging a wall. For the purposes of the present invention, a wall includes existing or permanent walls, moveable walls, partitions, and the like. Although the present invention will be generally described in the context of a preferred embodiment, namely a room with walls of sheet rock, those skilled in the art will recognize that the present invention is not limited to the preferred embodiment.

Referring now to the drawings, in which like numerals represent like elements throughout the several figures, aspects of the present invention and the preferred operating environment will be described.

Turning to FIG. 1, the preferred environment of the present invention will be described. FIG. 1 is a perspective view of a room with a back wall 2 and a side wall 4 covered with fabric wall panels 10 in accordance with the preferred environment of the present invention. The room also has a ceiling 6 and a floor 7. The back wall 2 and side wall 4 converge at a corner 8.

Each of the fabric wall panels 10 is similarly constructed. Fabric wall panel 10 comprises a rectangular frame 12 and flat filler insert 22. The frame 12 is made up of four linear frame members 14, 16, 18, and 20. The linear frame members 14, 16, 18, and 20 are extrusions made of polyvinyl chloride (PVC). The preferred PVC is 7045 White 08 PVC sold by Georgia Gulf Corporation of Plaquemine, La. Metal extrusions including aluminum extrusions may also be used for the linear frame members. Because all of the fabric panels 10 are similarly constructed using four linear frame members, the remainder of this discussion will be focused on one of the frame members, namely linear frame member 16.

Figure 2:
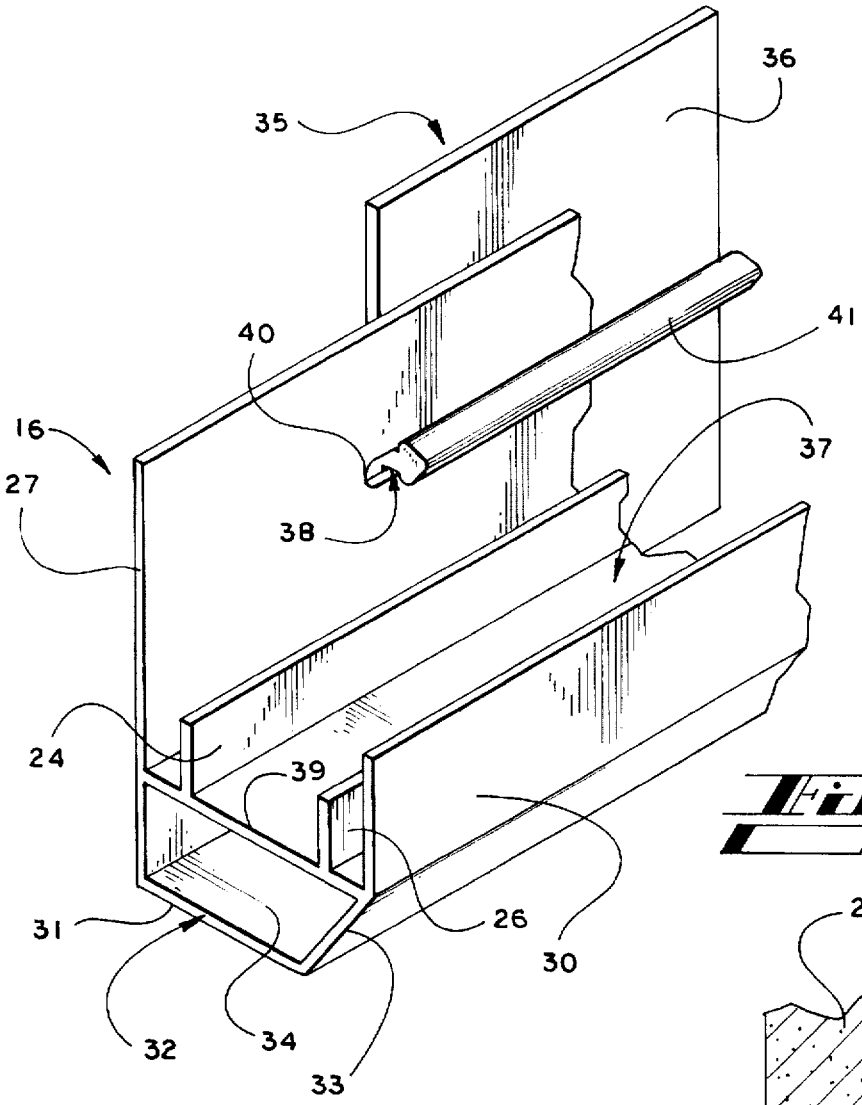
FIG. 2 is a perspective view of a linear frame member and hanger in accordance with the preferred embodiment of the present invention.
Figure 3:
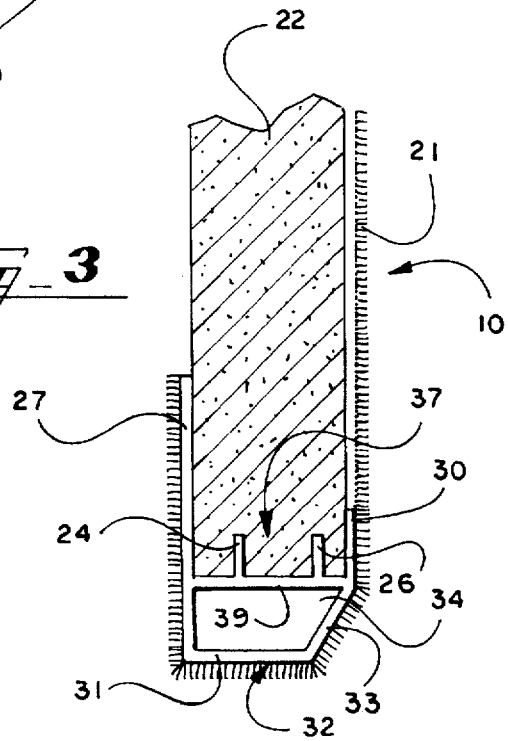
FIG. 3 is a cross-section view of a fabric wall panel in accordance with the preferred embodiment of the present invention.

Referring now to FIGS. 1 and 2, the linear frame member 16 includes a flat spine 27 with an opening or elongated slit 40, a side edge 32, and a front edge 30. The flat spine 27 is wider than the front edge 30. The side edge 32 comprises section 31, section 33, and web 39. The sections 31 and 33 and the web 39 enclose a hollow channel 34. The sections 31 and 33 may either be straight as shown in FIG. 3 or may be curved or of any other shape to provide an aesthetically pleasing side configuration. The web 39 intersects the front edge 30 and the flat spine 27 to form a groove 37 for retaining a flat filler insert 22. The web 39 has inner grooves 24 and 26 which further engage and stabilize the filler insert 22 as shown in FIG. 3.

The insert 22 may consist of any number of materials to provide sound or heat insulation. Preferably the insert is an acoustical insert in the nature of a rigid board such as Owens/Corning 705 Fiberglas insulation board sold by Owens/Corning Fiberglas Corp. of Toledo, Ohio. Of equal preference is a mineral fiber board insert such as Micore board sold by USG Acoustical Products Company of Chicago, Ill. The thickness of the insert 22 equals the distance between the spine 27 and the front edge 30 so that the insert 22 fits securely within the grooves 37 of each frame member 14, 16, 18, and 20.

When the fabric wall panel 10 is prefabricated, the linear frame members 14, 16, 18, and 20 are miter-cut and the rectangular frame 12 is formed by friction-fitting the filler insert 22 within the groove 37 of the frame members 14, 16, 18, and 20. The insert 22 not only provides sound or heat insulation, but it also provides rigidity to the frame 12. The linear frame members 14, 16, 18, and 20 are then connected together at the corners by suitable fasteners or gluing. The fabric wall panel 10 is completed by stretching fabric 21 over the insert 22 and frame 12, around the side edges 32 and gluing the fabric 21 to the back of the spine 27. In the preferred embodiment of the present invention, SM high-strength adhesive 90 sold by 3M Company of St. Paul, Minn., has been found to be suitable for gluing a large number of fabrics to the PVC material of the frame 12. The fabric may be attached in any other suitable fashion such as by stapling. Once the fabric wall panel 10 has been prefabricated, it is attached to the wall using hangers 35.

With reference to FIGS. 4(*a*) and 4(*b*), the hanger 35 for mounting the fabric wall panel 10 onto the wall in accordance with the preferred embodiment of the present invention comprises a flat base 36 and a perpendicularly extending tongue 38. The tongue 38 has an enlarged head 41 which is sized to snap into the elongated slit 40 of the frame member 16. The hanger is preferably made of the same material as the frame members.

With reference to FIG. 5, the hanger 35, which is one of a several hangers, is mounted to the wall 2 by means of an adhesive applied to the wall. The number of hangers 35 depends on the size and weight of the fabric wall panel 10 being hung. A separate contact adhesive on the back of the hanger 35 secures the hanger 35 to the wall 2 until the separately applied adhesive has fully cured. Other suitable means for attaching the hanger to the wall may be employed. Each hanger 35 is positioned on the wall so that the matching elongated slit 40 on the spine 27 of each frame member is aligned with the tongue 38 on one of the hangers 35. The tongues 38 with enlarged heads 41 are then snapped into the slits 40 on the fabric wall panel 10 by applying pressure to the fabric panel 10. In other words, the fabric wall panel 10 is affixed to the wall by pressing it against each hanger 35 so that the tongue 38 on each hanger is forced through each aligned slit 40 on the fabric wall panel 10, thereby securing the fabric wall panel 10 to the wall.

On-site customization of fabric wall panels 10 is a simple process. The linear frame members 14, 16, 18, and 20 are first cut to the exact size of the space required, and the ends are mitered to accommodate the exact angles of the wall space. Once cut and mitered, the linear frame members 14, 16, 18, and 20 are then temporarily attached to the wall to assure accuracy of the cuts. The flat filler insert 22 is then cut according to the measurements of the temporarily attached frame members 14, 16, 18, and 20 so that the insert 22 fits securely within the grooves 37 of each frame member. The frame members are removed from the wall, and the insert 22 is friction-fitted within the grooves 37 of the frame members 14, 16, 18, and 20), as previously described. The fabric 21 is attached by stretching it over the frame 12 and gluing it to the back of the spine 27 of the linear frame members 14, 16, 18, and 20. With the fabric 21 attached, the fabric wall panel 10 is reinstalled on the wall using hangers 35, as previously described.

Once fabric wall panels 10 have been installed according to the above-described system, removal and replacement of the fabric wall panels 10 is a simpler process. Any fabric wall panel 10 can be independently removed by unsnapping the fabric wall panel 10 from the supporting hangers 35. Another panel may be installed in the other panel's place by simply snapping the new panel onto the existing hangers. If one desires to remove the panels entirely, all of the panels can be removed by unsnapping each panel from the supporting hanger and removing the hangers from the wall.

In summary, the present invention provides an improved and simplified fabric wall panel system for installing fabric wall panels employing a snap hanger. By utilizing the disclosed method for installing fabric wall panels, the removal and replacement process is less complicated. Therefore, the preferred embodiment of the present invention allows for easy installation and removal of fabric wall panels, whereby the procedure does not damage the wall.

Alternative embodiments will become apparent to those skilled in the art to which the present invention pertains without departing from its spirit and scope. Accordingly, the scope of the present invention is defined by the appended claims rather than the foregoing description.

I claim:

1. A fabric wall panel system comprising:

a. a fabric wall panel comprising:

i. a frame comprising a plurality of frame members, each frame member comprising:

a. a flat spine with an elongated slit therein, b. a hollow channel forming a peripheral edge, and c. a front edge, which together define a groove;

ii. an insert fitted within the groove; and b. a hanger comprising:

i. a base; and ii. an elongated tongue having an enlarged head for engaging the elongated slit on the spine of the frame, whereby the hanger is affixed to a wall in an aligning relationship to the elongated slit in the spine of the frame member and the frame member is pressed so that the elongated tongue of the hanger is inserted in the elongated slit in the spine of frame member.

2. The fabric wall panel system of claim 1, wherein the groove has inner grooves for engaging and holding the insert.

3. A method for installing a fabric wall panel on a wall, comprising the steps of:

a. assembling a fabric wall panel by:

i. assembling a frame comprising a plurality of frame members, each frame member comprising:

a. a flat spine with an elongated slit therein, b. a hollow channel forming a peripheral edge, and c. a front edge, which together define a groove, wherein the groove has inner grooves;

ii. fitting an insert within the groove so that the inner grooves engage and hold the insert;

b. affixing a plurality of hangers to the wall in an aligning relationship to the elongated slits in the spines of the frame members, each hanger comprising:

i. a base; and ii. an elongated tongue having an enlarged head for engaging the elongated slit on the spine of the frame; and c. engaging the elongated tongue of the hanger with the aligned elongated slits of the spines and pressing the fabric wall panel so that the elongated tongues are inserted in the elongated slits.

4. The method of claim 3, wherein the method further comprises the step of removing the fabric wall panel by pulling the elongated slits from engagement with the elongated tongues.

* * * * *